US006053317A

United States Patent [19]

Morris et al.

[11] Patent Number: 6,053,317

[45] Date of Patent: Apr. 25, 2000

[54] BOTTLE CARRIER

[76] Inventors: Robert R. Morris; Nina W. Cornell, both of 1290 Wood River Rd., 1290 Road 4DT, Meeteetse, Wyo. 82433

[21] Appl. No.: 09/313,401

[22] Filed: May 18, 1999

Related U.S. Application Data

[60] Provisional application No. 60/085,800, May 18, 1998, and provisional application No. 60/085,976, May 19, 1998.

[51] Int. Cl.[7] ..... B65D 81/02

[52] U.S. Cl. ..... 206/433; 206/588; 229/91

[58] Field of Search ..... 206/523, 588, 206/589, 592, 139, 433, 427; 229/89, 91; 220/509

[56] References Cited

U.S. PATENT DOCUMENTS

| | | | |
|---|---|---|---|
| 2,317,554 | 4/1943 | Risch . | |
| 2,376,194 | 5/1945 | Samuels . | |
| 2,458,737 | 1/1949 | Salkowitz . | |
| 2,464,069 | 3/1949 | Benson . | |
| 3,002,640 | 10/1961 | Kline . | |
| 3,322,383 | 5/1967 | Weinberg . | |
| 3,779,298 | 12/1973 | Piccirillli et al. . | |
| 4,197,890 | 4/1980 | Simko . | |
| 4,282,279 | 8/1981 | Strickland | 229/91 X |
| 4,428,484 | 1/1984 | Rattay et al. . | |
| 5,065,879 | 11/1991 | King | 229/91 X |
| 5,095,718 | 3/1992 | Ormond et al. | 206/433 |
| 5,213,215 | 5/1993 | Prevot . | |
| 5,215,208 | 6/1993 | Jackson | 220/509 |
| 5,680,958 | 10/1997 | Mann et al. . | |

*Primary Examiner*—Jacob K. Ackun

[57] ABSTRACT

A portable carrier for transporting necked bottles includes a tubular housing with an open end configured to receive a bottle, a lid configured to fit over the open end of the tubular housing, and a neck protector disposed within the tubular housing and defining an opening for receiving the neck of the bottle. The tubular housing preferably includes one or more sheets of a high-density, closed-cell sponge material formed into a hollow cylinder with opposed longitudinal edges, and further includes an adjustable fastener such as a zipper for selectively joining the longitudinal edges of the tubular housing together. In a preferred embodiment, straps or other types of cinching members extend circumferentially around the tubular housing at longitudinally spaced locations to permit the diameter of the tubular housing to be varied along its length to accommodate bottles of various shapes and sizes.

30 Claims, 10 Drawing Sheets

BOTTLE CARRIER

CROSS-REFERENCE TO RELATED APPLICATIONS

This application claims the benefit of U.S. Provisional Patent Application Ser. No. 60/085,800 filed on May 18, 1998 and U.S. Provisional Patent Application Ser. No. 60/085,976 filed on May 19, 1998, the disclosures of which are incorporated herein by reference.

BACKGROUND OF THE INVENTION

1. Field of the Invention

The present invention relates generally to bottle carriers and, more particularly, to a bottle carrier which can be placed in checked luggage to safely transport bottles and bottled goods when traveling.

2. Discussion of the Background Art

Individuals who collect bottles or enjoy bottled goods such as fine wine often acquire bottles while traveling and must find a way to safely transport the bottles from one location to another. In the past, such individuals were forced to either ship the bottles by mail at great expense or place the bottles directly in their luggage relying on the items packed around the bottles for protection. Unfortunately, luggage is often handled roughly and thrown about such that bottles packed in the luggage can shift and break. If the bottles contain liquids such as wine, surrounding items such as clothing and electronics can be ruined.

It is known to ship bottles commercially in boxes containing foamed polystyrene shims and collars that fit over the necks of the bottles, for example as disclosed in U.S. Pat. No. 5,213,215 to Prevot. While such shipping boxes are suitable for mail and other types of commercial transport utilizing the cargo holds of airplanes and ships, they are too bulky for practical use in luggage due to the extremely limited space available therein. In addition, the size of the bottle being shipped is limited by the dimensions of the box in which the shims are placed.

SUMMARY OF THE INVENTION

Accordingly, it is an object of the present invention to satisfy the need for a bottle carrier that can be placed in checked luggage to safely transport necked bottles and bottled goods when traveling.

These and other objects are achieved with the present invention which is generally characterized in a portable carrier for transporting necked bottles including a tubular housing formed of a semi-rigid shock absorbing material defining a compartment with an open end configured to receive a bottle, a lid configured to fit over the open end of the compartment, and a neck protector formed of a flexible shock absorbing material disposed within the tubular housing and defining an opening for receiving the neck of the bottle. The tubular housing can be formed by a sheet of closed-cell sponge material formed into a hollow cylinder with opposed longitudinal edges, with a manually operable fastener such as a zipper being used to selectively join the longitudinal edges of the tubular housing together. In a preferred embodiment, straps or other types of cinching members extend circumferentially around the tubular housing to change the diameter of the tubular housing to accommodate bottles of various diameters.

Another aspect of the present invention is generally characterized in a method of transporting necked bottles including the steps of inserting a bottle into an open end of a compartment defined by a housing formed of a high-density, closed-cell foam material, placing the neck of the bottle in an opening defined at least part way through a neck protector formed of a low-density, open-cell foam material disposed within the compartment, adjusting a dimension of the housing using a strap extending around the housing, closing the open end of the housing with a lid, and placing the bottle carrier in an article of luggage.

Other objects and advantages of the present invention will become apparent from the following description of the preferred embodiments taken with the accompanying drawings, wherein like parts in each of the several figures are identified by the same reference numerals or by reference numerals having the same last two digits.

DETAILED DESCRIPTION OF THE PREFERRED EMBODIMENTS

Figures 1, 2, 3, 4, 5:
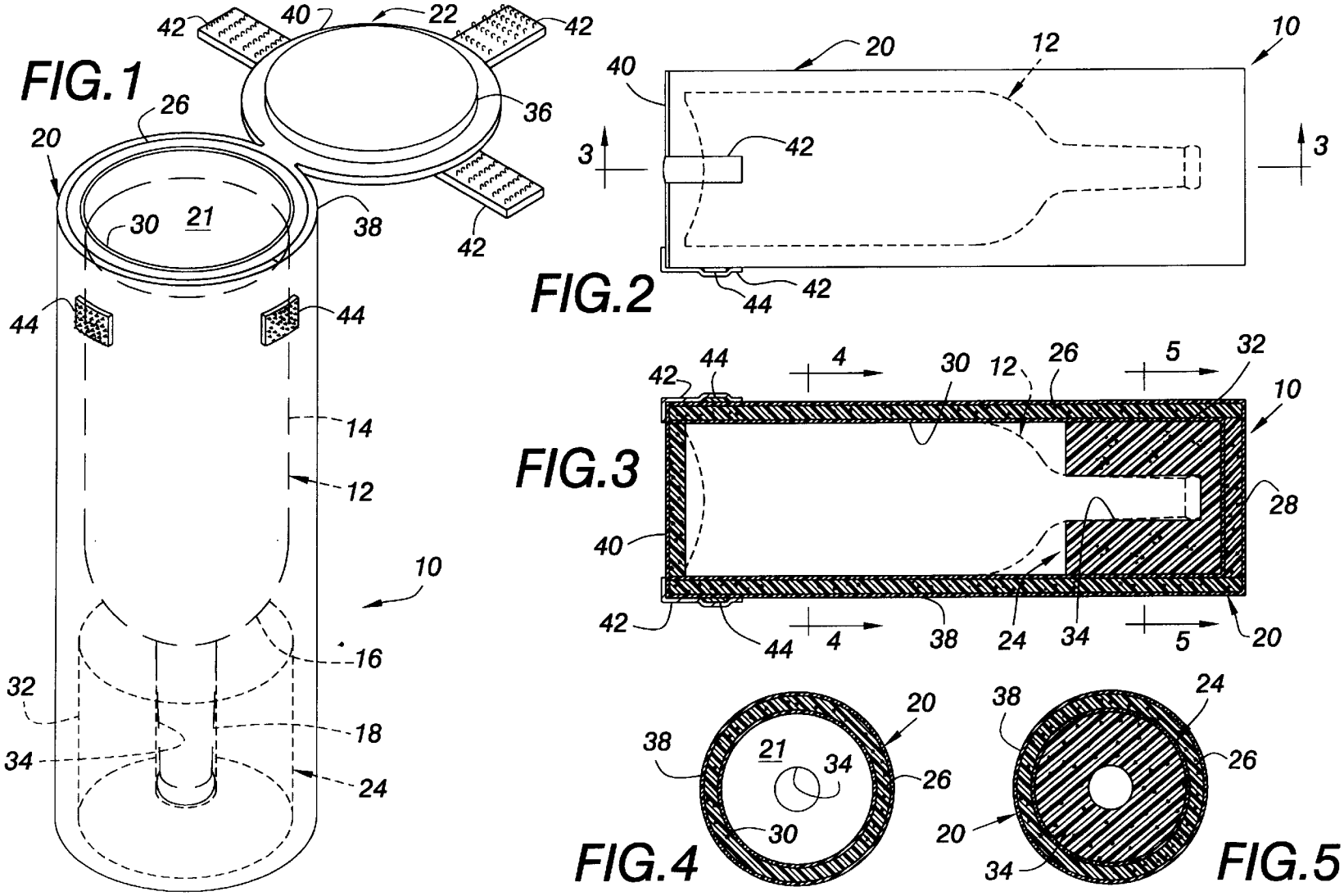
FIG. 1 is a perspective view of a bottle carrier according to the present invention.
FIG. 2 is a side view of the bottle carrier shown in FIG. 1.
FIG. 3 is a sectional view of the bottle carrier of FIG. 1 taken through line 3—3 in FIG. 2.
FIG. 4 is a sectional view of the bottle carrier of FIG. 1 taken through line 4—4 in FIG. 3.
FIG. 5 is a sectional view of the bottle carrier of FIG. 1 taken through line 5—5 in FIG. 3.

A bottle carrier 10 according to the present invention is shown in FIG. 1 carrying a conventional wine bottle 12 with a cylindrical body 14 and a tapered shoulder 16 connecting the body with an elongate cylindrical neck 18 of smaller diameter than the body. Bottle carrier 10 includes a housing 20 of tubular configuration defining a compartment 21 with an open end configured to receive a bottle, a cover or lid 22 configured to fit over the open end of the compartment, and a neck protector 24 disposed within the tubular housing adjacent a closed end of the tubular housing to receive the neck of the bottle. Housing 20 is formed of a hollow cylinder 26 made of a semi-rigid, shock absorbing material such as a high density closed-cell foam, an end cap 28 disposed at one end of the cylinder and made of the same or similar material as the cylinder, and a liner 30 disposed along an inner surface of the cylinder and made of relatively smooth material such as a natural or synthetic fabric. End cap 28 is shown as a circular disk inserted in one end of the cylinder 26 and adhesively bonded thereto to define a closed end of the housing in a manner which increases the stiffness of the cylinder in the vicinity of neck protector 24.

Neck protector 24 is formed of a cylindrical block 32 made of a flexible, shock absorbing material such as a soft, flexible low density open-cell foam. The cylindrical neck protector block 32 is disposed telescopically within tubular housing 20 adjacent end cap 28 and is preferably adhesively bonded or otherwise affixed to the housing as an integral component to assure proper positioning of the neck protector and to prevent loss thereof. The neck protector block defines an opening 34 in the form of a cylindrical recess oriented along a longitudinal axis of the housing to receive the neck of a bottle therein, the relatively soft and flexible material of the neck allowing the recess to expand in diameter to snugly receive bottle necks of various diameters without the need of having to replace the neck protector. It will be appreciated that the neck protector mitigates the effects of a lateral impact by filling the space between the bottle neck and the relatively rigid cylindrical housing portion with a relatively flexible material which does not readily transmit impact loads while at the same time slowing any lateral movement of the bottle neck. Neck protector opening 34 preferably extends only part way through the neck protector so that a layer (e.g., about 0.5 inch thick) of the relatively flexible, shock absorbing neck protector material remains between the mouth at the end of the bottle neck and the relatively rigid, closed end 28 of the housing in the event of an axial or longitudinal shock or impact.

Lid 22 includes a disk 36 formed of a semi-rigid, shock absorbing material the same as or similar to the housing material and configured to fit within the open end of cylindrical housing portion 26 in a snug but removable manner. An outer covering 38 is disposed about the exterior of the housing and includes a flap 40 which overlaps the open end of the housing to form a part of the lid which mounts disk 36 in a hinged manner allowing the disk to pivot relative to the housing between an open position where the disk is dislodged from the open end of the housing as shown in FIG. 1 and a closed position where the disk is inserted into the open end of the housing as shown in FIG. 2. A plurality of fastener components 42 are spaced about the circumference of lid 22 and configured to mate with cooperating components 44 on housing 20 to retain the lid in the closed position when desired. Hook and loop fasteners are shown, however, any suitable fasteners can be used.

In use, a bottle carrier 10 having an appropriate inner diameter is chosen and prepared to receive the bottle 12 by removing lid 22 from tubular housing 20, for example by unfastening flap 40 and withdrawing disk 36 from the open end of the housing. Since the lid is hinged at the end of the housing, the lid will hang from the housing in the open position thereby preventing loss of the lid and freeing the hands for safe insertion of the bottle. Similarly, because neck protector 24 is affixed within the housing, there is no possibility of the neck protector falling from the housing and becoming lost or misaligned. With the lid removed, the bottle is placed in the carrier by inserting the neck 18 of the bottle into the open end of the housing and moving the bottle axially in the direction of the neck protector at the closed end of the housing. As the bottle is inserted into the carrier, the body 14 of the bottle slides within the tubular housing in telescoping relation thereby automatically centering the neck with the opening 34 formed part way through the center of the neck protector. Since the interior of the tubular housing is lined with a smooth material 30, insertion of the bottle is easily accomplished with little or no jerkiness which might result in loss of control and/or dropping of the bottle. Opening 34 in the neck protector will expand to accommodate the diameter of the neck as the bottle is inserted into the housing and the opening is preferably deep enough to allow the neck protector to contact and conform somewhat to the shape of the shoulder 16 connecting the neck with the body of the bottle to resist axial movement of the bottle within the carrier while assuring that the areas of highest stress concentration are maintained in spaced relation to the rigid shell defined by the housing. When the bottle is fully seated within housing, lid 22 is placed over the open end of the housing and secured in place to press disk 36 against the bottom of the bottle, thereby encapsulating the bottle within a relatively rigid shell of generally cylindrical configuration. The bottle carrier can be conveniently placed within a suitcase (not shown) or any other type of luggage for transport without taking up excessive room within the luggage or adding excessive weight which might prevent the traveler from carrying the luggage with a handle or shoulder strap. If the luggage is dropped or handled roughly, impact forces are absorbed somewhat by the relatively rigid closed-cell foam making up the housing and lid of the carrier and are prevented from being transmitted to the neck of the bottle by the annular space separating the neck from the cylindrical housing and by the relatively flexible open-cell foam which is disposed in the space between the rigid cylindrical shell and the neck to slow any whipping motion of the neck without transmitting impact forces. Moreover, because the neck protector engages the shoulder of the bottle, axial movements of the bottle are attenuated such that the bottle may survive axial impacts.

From the above, it will be appreciated that the cylindrical housing portion, end cap and disk of the carrier cooperate in an assembled condition to define a relatively rigid shell which conforms to the body of a bottle and extends upwardly therefrom in radially spaced relation to the neck to define an annular space therebetween. The neck protector fills the space between the housing and the neck to prevent direct transmission of impact loads while gently inhibiting lateral and axial movement of the neck and providing flexible neck sizing for the carrier without compromising structural rigidity.

The tubular housing and lid of the carrier can be formed of any type of rigid or semi-rigid, shock absorbing material including, but not limited to, high density closed-cell polymeric foams such as polyethylene and polyurethane foams, silicone rubber and various composite materials. In one embodiment, semi-rigid portions of the carrier such as the tubular housing and lid are formed of a high density closed-cell polyethylene foam (e.g., having a thickness of about 0.5 inch, a density of about 4 to about 6 $lb/ft^3$ (pcf), 25% compression deflection at about 10 to about 20 $lb/in^2$ (psi), 50% compression set at about 29 to about 16% original thickness, tensile strength of about 50 to about 160 psi, and elongation to break of about 150% to about 220%). The neck protector can be formed of any soft, flexible material including, but not limited to, low density open-cell polymeric foams, to provide greater flexibility allowing the protector to conform the shape of the bottle neck and the tapered shoulder connecting the neck with the body of the bottle. An exemplary material for the neck protector is a low density open-cell polyethylene foam (e.g., having a density from about 1 to about 4 pcf), however, other soft flexible materials can be used. The liner is preferably made of a nylon fabric but can be made of any material sufficiently smooth to ease insertion of the bottle into the tubular housing including, but not limited to, felt, rubberized and bare fabrics, and fabrics treated or coated with friction reducing compounds such as polytetrafluoroethylene (PTFE or TEFLON). The outer covering can be made of any desirable material such as, for example, synthetic and natural fabrics, leather, vinyl or simulated leather. Alternatively, the carrier can be produced without a liner or an outer covering.

The carrier according to the present invention can be modified to include an adjustable inner diameter to accommodate bottles of various diameters while retaining a low profile and sufficient structural rigidity to support and protect the bottle. For example, in FIGS. 6–10, a modification of the bottle carrier according to the present invention is shown wherein the tubular housing 120 of the modified carrier 110 is formed by a sheet of shock absorbing material 126 wrapped around the bottle and secured with adjustable fasteners 146. Sheet 126 is rectangular in an unfurled or flat condition with overlapping edges of the sheet being tapered in a cooperative manner as shown at 148 and 150 in FIGS. 9 and 10 to maintain a substantially continuous wall thickness when laid over one another so that the outer surface of the tubular housing appears substantially cylindrical without space consuming bulges. The sheet can be formed of any of the semi-rigid materials discussed above and is shown with a liner 130 and outer covering 138 similar to those discussed above. Fasteners 146 in the form of plastic side-release buckles, such as those marketed and sold by Illinois Tool Works (ITW) as FASTEX brand buckles, are shown mounted on straps 152 attached to the sheet at longitudinally spaced locations along overlapping edges of the sheet. Other types of fasteners that can be used to join overlapping edges of the sheet include, but are not limited to, snaps, laces, buttons, elastic bands, ratcheting buckles, and hook and loop fasteners.

The outer covering 138 of the modified bottle carrier 110 extends beyond laterally opposed edges of the rectangular sheet of material 126 to define a pair of flaps 140 of circular configuration carrying disks 136 similar to the disk described above such that, when the sheet is wrapped around a bottle to form a tubular housing, the lids 122 defined by the flaps and disks can be pivoted over open ends of the tubular housing and secured with fasteners 142 and 144 in the manner described above to prevent the bottle from sliding out of the carrier during transport while at the same time increasing the structural rigidity of the carrier.

Neck protector 124 for the modified carrier is similar to the neck protector described above but is removably affixed to an inner surface of tubular housing 120, e.g. with hook and loop fasteners, so that neck protectors of different diameter can be substituted dependent upon the size of the bottle to be carried.

Figures 6, 7, 8, 9, 10:
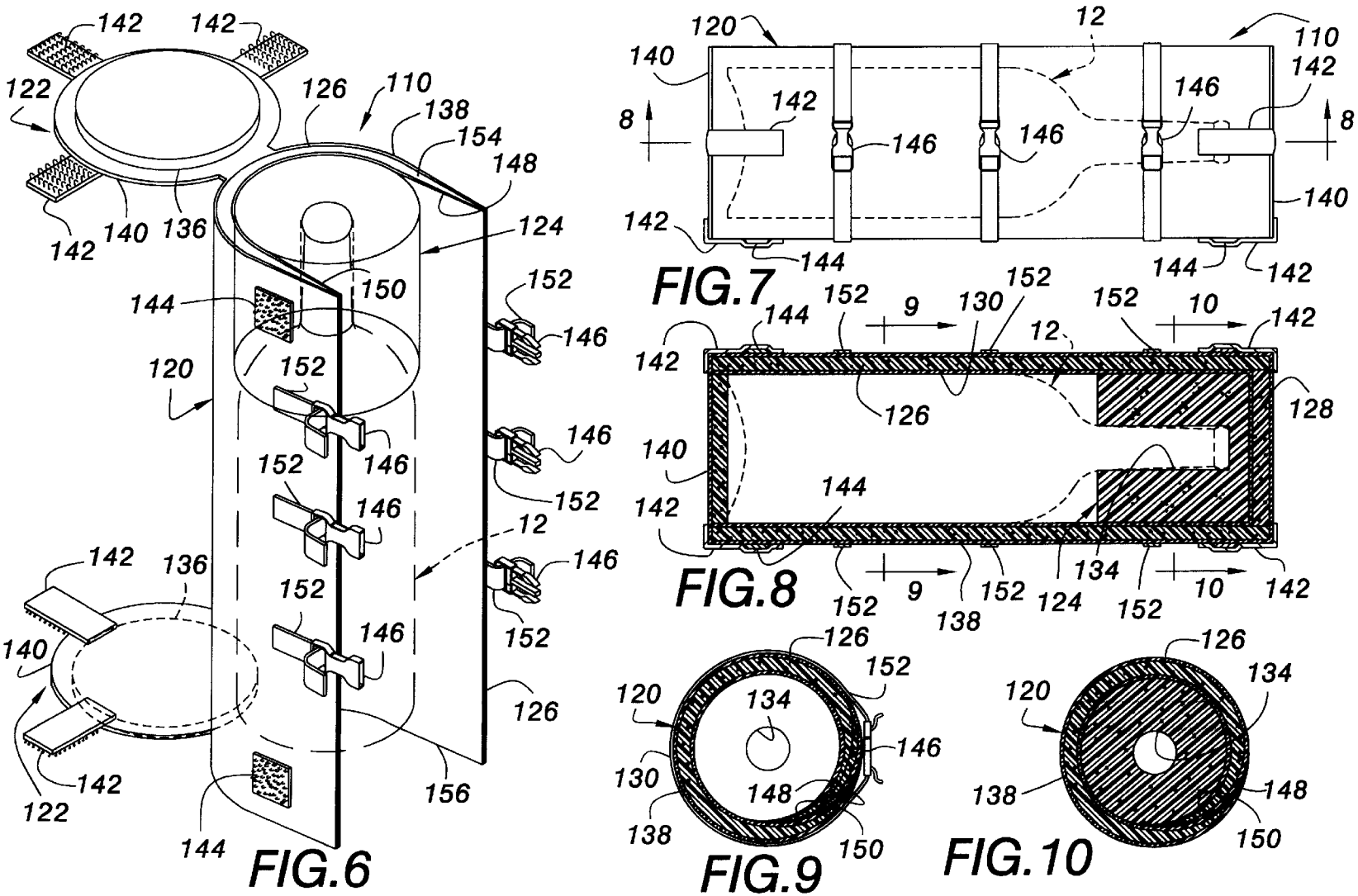
FIG. 6 is a perspective view of a modification of the bottle carrier according to the present invention.
FIG. 7 is a side view of the bottle carrier shown in FIG. 6.
FIG. 8 is a sectional view of the bottle carrier of FIG. 6 taken through line 8—8 in FIG. 7.
FIG. 9 is a sectional view of the bottle carrier of FIG. 6 taken through line 9—9 in FIG. 8.
FIG. 10 is a sectional view of the bottle carrier of FIG. 6 taken through line 10—10 in FIG. 8.
Figure 12:
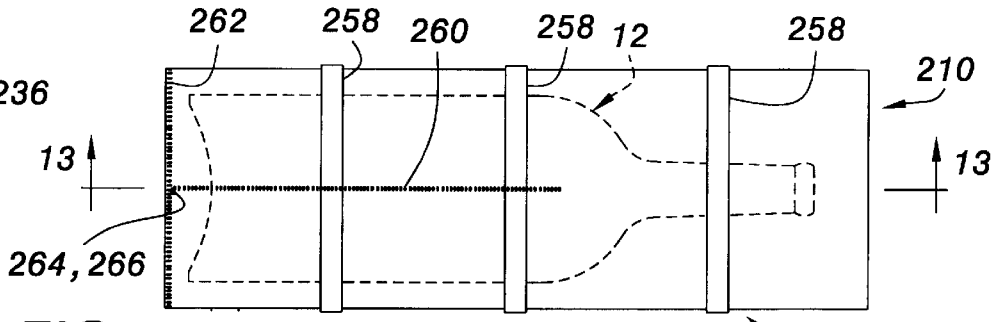
FIG. 12 is a side view of the bottle carrier shown in FIG. 11.
Figure 13:
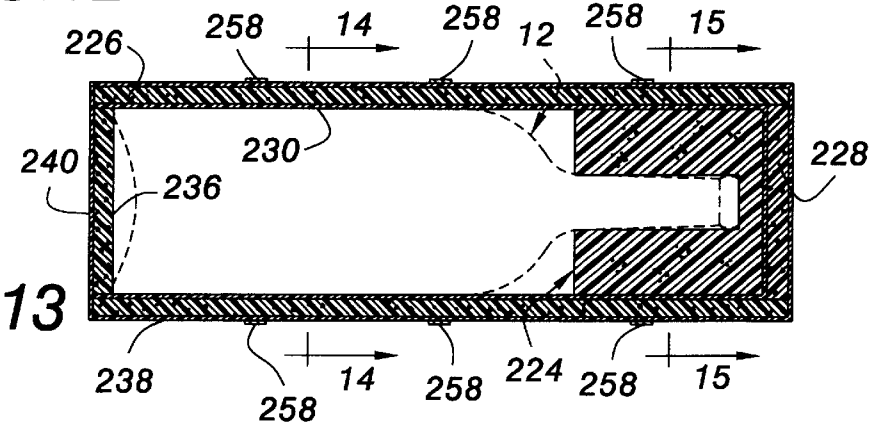
FIG. 13 is a sectional view of the bottle carrier of FIG. 11 taken through line 13—13 in FIG. 12.
Figure 15:
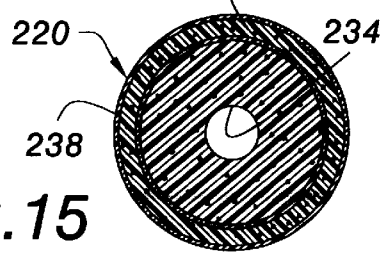
FIG. 15 is a sectional view of the bottle carrier of FIG. 11 taken through line 15—15 in FIG. 13.
Figure 14:
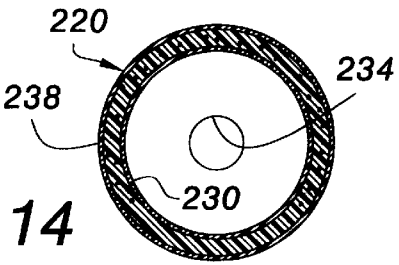
FIG. 14 is a sectional view of the bottle carrier of FIG. 11 taken through line 14—14 in FIG. 13.

In use, a neck protector 124 having an outer diameter similar to the diameter of the bottle 12 is chosen and placed over the neck 18 of the bottle. The bottle 12 is laid against the inner surface of the rectangular sheet of material 126 with the neck protector 124 such that the neck of the bottle is received within the neck protector and the neck protector is affixed to the inner surface of the rectangular sheet of material in a removable manner. Proper spacing of the neck protector and the bottle from lateral edges 154 and 156 of the sheet is easily achieved by positioning the neck protector fasteners at predetermined locations corresponding to the correct placement of the neck protector. The sheet 126 is then rolled or wrapped tightly around the bottle 12 and the neck protector 124 such that tapered edges 148 and 150 of the sheet abut or slide against one another as shown in FIGS. 9 and 10 to form a cylindrical housing portion 126 of substantially constant wall thickness so that the overall size of the carrier is about the same as for the non-adjustable carrier shown in FIG. 1. The amount of overlap will depend upon the diameter of the bottle to be carried but will typically range from about 0 to about 1 inch, with greater overlap tending to result in greater structural rigidity. With edges of the sheet overlapping, the buckles 146 disposed along the overlapping edges of the sheet are fastened in the conventional manner and tightened by pulling adjustment straps 152 such that the body 14 of the bottle is held tightly within the tubular housing 120 formed by the wrapped sheet of material. Disks 136 are inserted into open ends of the tubular housing 120 by pivoting the lids 122 from the open positions shown in FIG. 6 to the closed positions shown in FIG. 7 and are secured with fasteners 142 and 144. The modified carrier 110 may then be placed in luggage as described above and will operate in a similar manner.

In FIGS. 11–15, another modification of a bottle carrier according to the present invention is shown wherein the modified carrier 210 includes a tubular housing 220 similar to that shown in FIG. 1 but with a plurality of elastic belts 258 circumscribing the housing at longitudinally spaced locations to cinch the housing down to a smaller diameter and a zipper 260 extending longitudinally from an open end of the housing part way along the length of the housing. Neck protector 224 for the modified bottle carrier is similar to the neck protectors described above but is removably affixed to the inner surface of the housing 220 adjacent the closed end or end cap 228 of the housing using any type of suitable fastener such as, for example, hook and loop fasteners. Accordingly, neck protectors of various diameters are readily substituted to accommodate bottles of different diameter. The modified housing 220 includes a liner 230 and outer covering 238 similar to those described above, and a lid 222 is formed by a flap of material 240 extending from the outer covering and mounting a disk 236 similar to the disks described above. A pair of zippers 262 extend circumferentially around lid 222 to secure the lid to the tubular housing in the closed position shown in FIG. 12. A hook 264 and latch 266 are provided on opposite sides of longitudinal zipper 260 to fix the diameter of the housing if desired.

Figure 11:
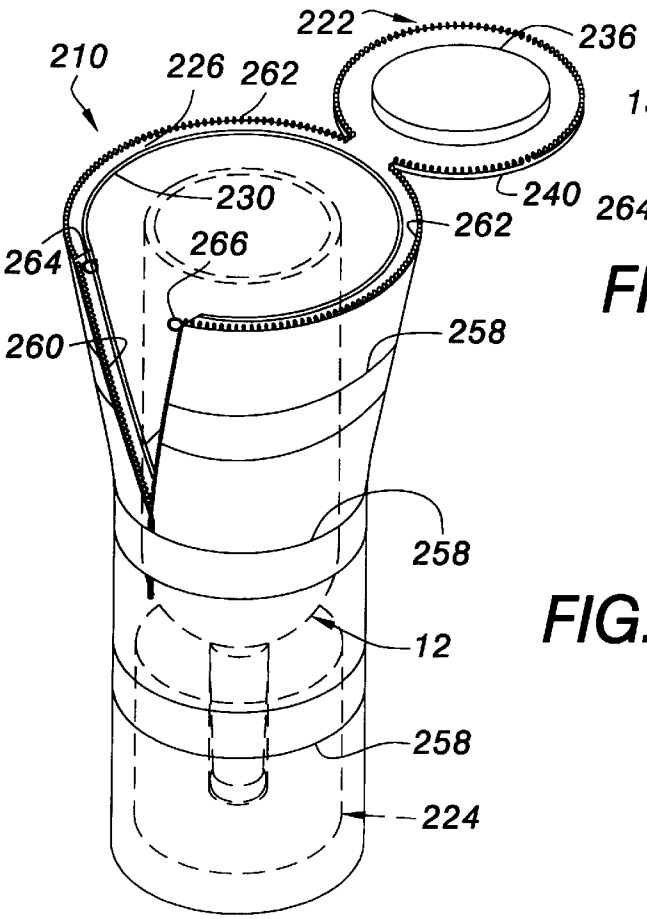
FIG. 11 is a perspective view of another modification of the bottle carrier according to the present invention.

Use of the modified bottle carrier 210 shown in FIG. 11 proceeds essentially as described above; however, because of the elastic belts 258, the semi-rigid housing material can expand diametrically somewhat to accommodate bottles of different diameter. In addition, the longitudinal zipper 260 allows the housing to be secured around the bottle in a simple and straight forward manner. If desired, the zipper can extend along the entire length of the housing, however, it is preferred that the zipper extend only part way along the length of the housing to maintain structural rigidity of the housing while at the same time simplifying replacement of the neck protector and insertion of the bottle.

Figure 16:
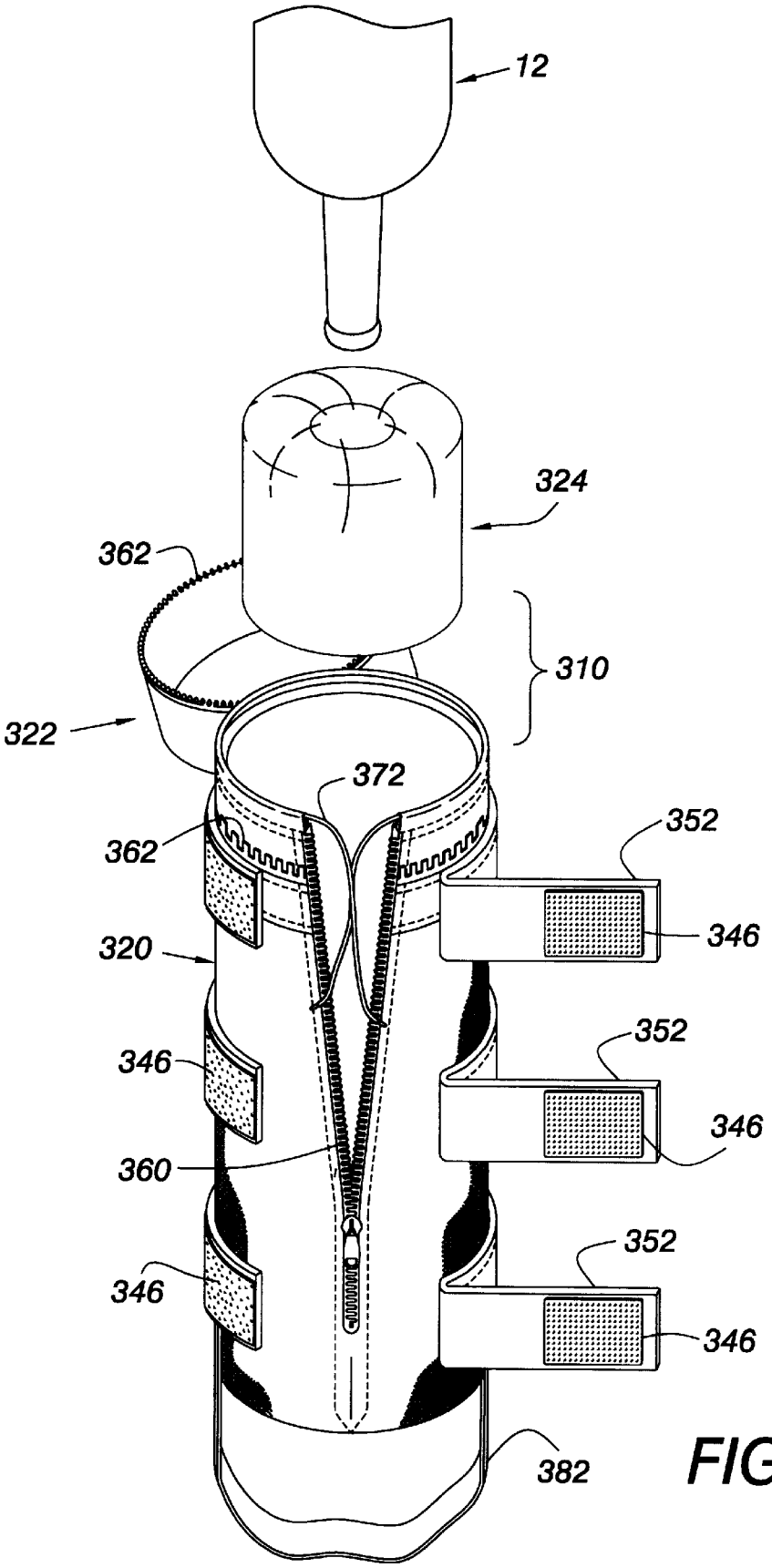
FIG. 16 is an exploded perspective view of yet another modification of the bottle carrier according to the present invention.
Figure 17:
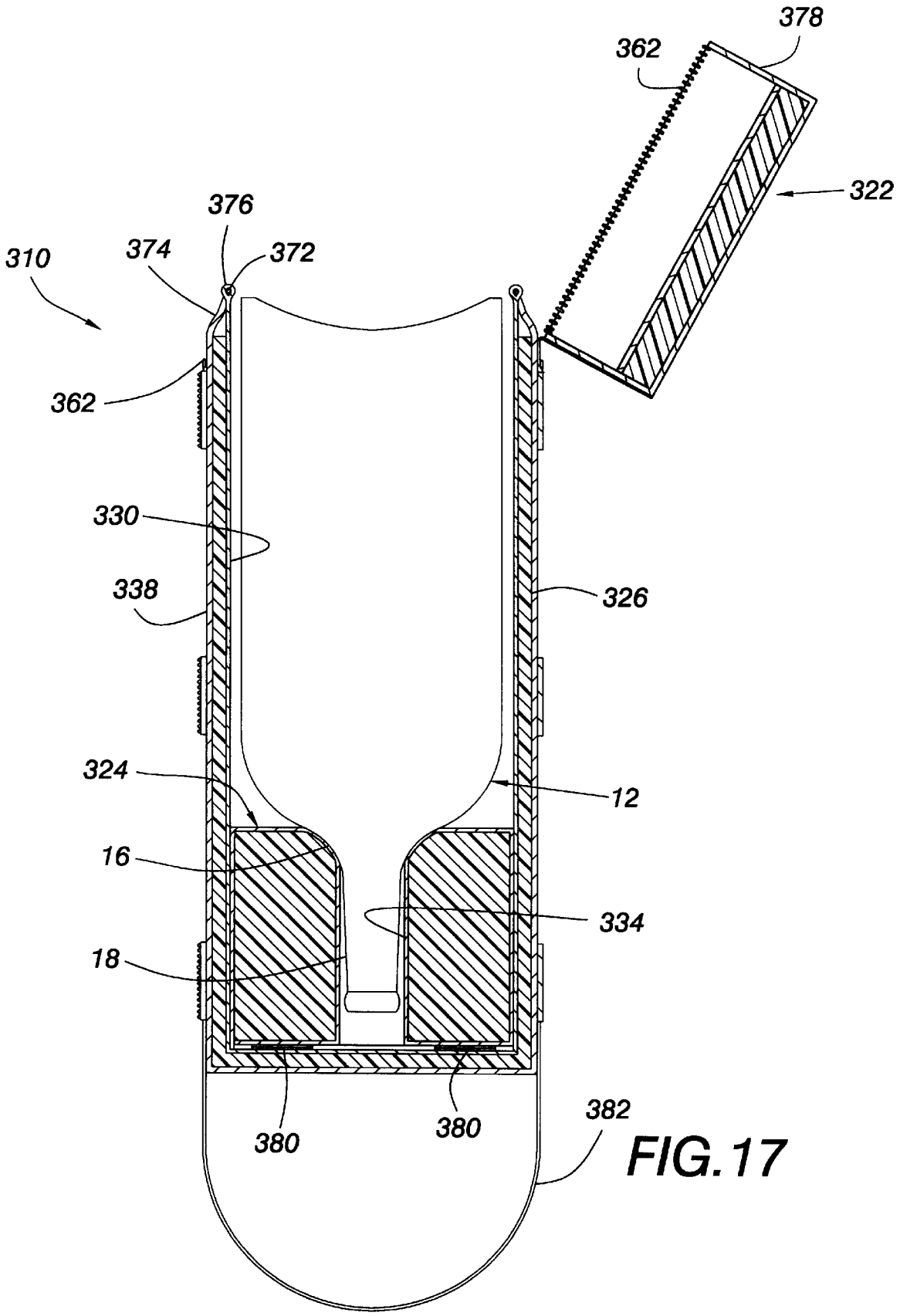
FIG. 17 is a side view, in section, of a bottle disposed with the bottle carrier of FIG. 16.
Figure 18:
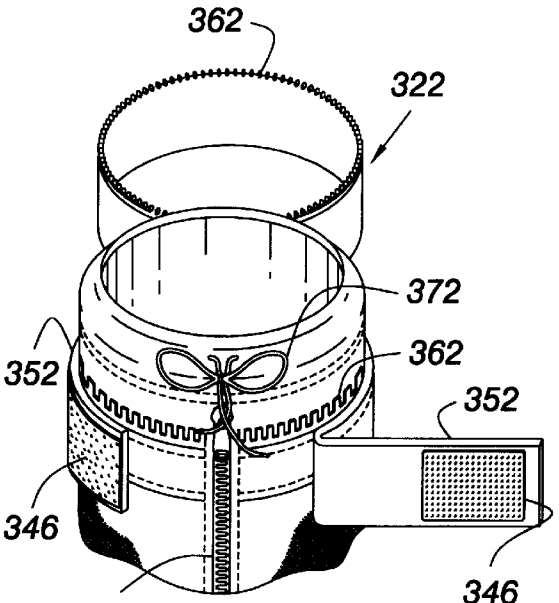
FIG. 18 is a top perspective view of the bottle carrier of FIG. 16 with belts unfastened.

Yet another modification of a bottle carrier according to the present invention, illustrated in FIGS. 16–20 at 310, is similar to the bottle carrier shown in FIG. 11 but with a closure in the form of a drawstring 372 at one end of housing 320 and adjustable straps 352 extending circumferentially around the exterior of the housing at longitudinally spaced locations. Housing 320 of the modified bottle carrier 310 includes one or more sheets of shock absorbing material 326 arranged in a tubular configuration with a pair of opposed longitudinal edges connected by a zippered fastener 360. The shock absorbing sheet or sheets can be formed of any of the semi-rigid materials discussed above and is shown with a liner 330 and outer covering 338 similar to those described above. As best seen in FIG. 18, liner 330 extends axially beyond the portion of the housing defined by the shock absorbing material 326 and is folded over and sewn to define a flexible or compliant collar 374 of cylindrical configuration with a pocket 376 extending circumferentially thereabout and a drawstring 372 threaded through the pocket allowing the collar to be tightly cinched around the bottom of a bottle in an adjustable manner so as to snugly secure the bottle within the protective compartment defined by the housing. Lid 322 is similar to those described above but includes a cylindrical skirt 378 that fits telescopically around collar 374 and includes a bottom edge that is secured to the housing by one or more zippered fasteners 362 extending circumferentially about the housing. The belts or straps 352 extending circumferentially about the housing at longitudinally spaced locations have ends carrying fastening elements 346 in the form of hook and loop fasteners that allow the circumferential length of the straps to be manually adjusted by varying the amount of overlap of the ends. As a result, the inside diameter or dimension of the compartment defined by the housing can be made to vary along the length of the carrier so as to accommodate a variety of bottle shapes and sizes. Three straps 352 are shown, however, it will be appreciated that fewer than three or more than three straps can be used dependent upon the degree of flexibility desired.

Referring to FIG. 17, it can be seen that neck protector 324 is similar to those described above but with an opening 334 that extends completely through the protector rather than defining a recess. To prevent the neck 18 of a bottle 12 from bottoming out against the end of the carrier, neck protector 324 is configured to have an axial length longer than the neck such that the shoulder region 16 is supported when the bottle is inserted into the carrier. By engaging the shoulder, the neck protector defines a gap between the end of the neck and the carrier that allows the bottle to decelerate gradually when loaded, the neck protector deforming to absorb the kinetic energy of the bottle in the event the carrier is dropped or handled roughly. The neck is also prevented from whipping in the event of a lateral impact. As explained previously, the neck protector is preferably detachably mounted within the housing, for example using hook and loop fasteners as shown, to keep the carrier components together and prevent expulsion when removing a tightly fitted bottle from the carrier.

Figure 20:
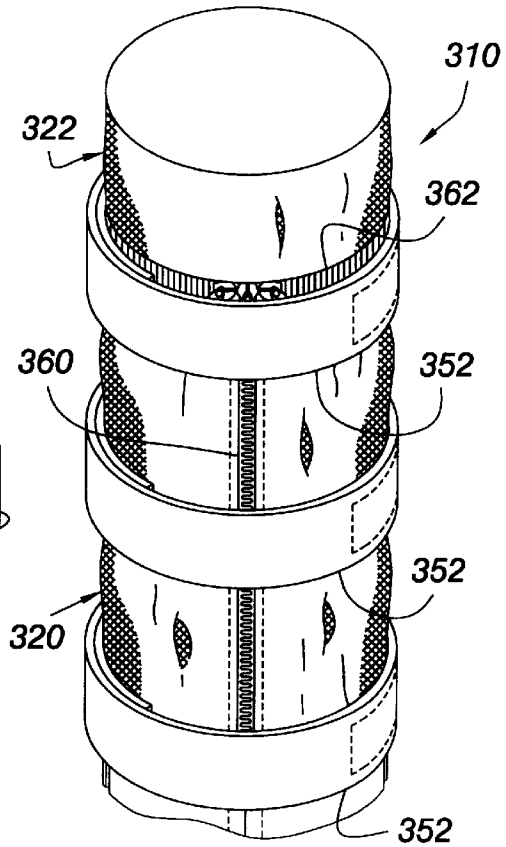
FIG. 20 is a fragmentary top perspective view of the bottle carrier of FIG. 16 with belts fastened and the lid closed.
Figure 19:
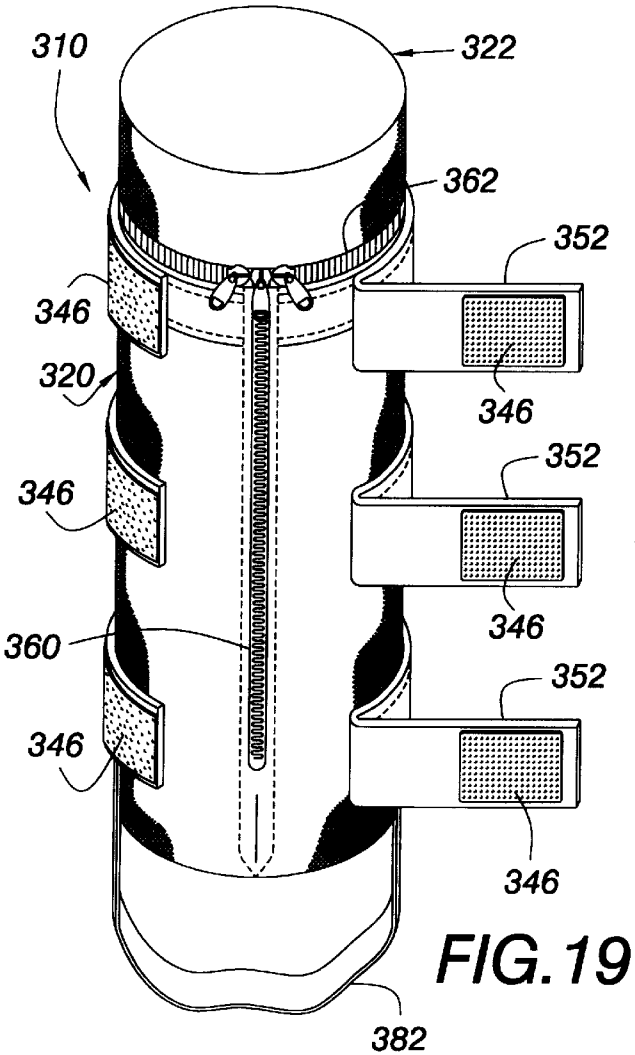
FIG. 19 is a fragmentary top perspective view of the bottle carrier of FIG. 16 with belts unfastened and the lid opened.

Use of the bottle carrier shown in FIGS. 16–20 proceeds essentially as described above. If the carrier is in a closed condition or state, as shown in FIG. 20, the ends of straps 352 are detached from one another, as shown in FIG. 19, and lid 322 is opened, as shown in FIG. 18. With lid 322 flipped back or away from the open end of the carrier, as shown in FIG. 17, drawstring 372 is untied and loosened. Zipper 360 fastening opposed longitudinal edges of the tubular housing can be opened, as shown in FIG. 16, to ease insertion of the bottle into the carrier. Neck protector 324 can be positioned around the neck of the bottle prior to or during insertion, and is preferably held in place by manually detachable fasteners such as hook and loop fasteners 380 as shown. When the bottle is fully inserted in the carrier such that the shoulder 16 of the bottle abuts neck protector 324, the zippered fastener 360 is closed to enclose the bottle within tubular housing 320 and the drawstring tightened 372 and tied underneath the bottom of the bottle for the reasons stated above. Lid 322 is then pivoted over the open end of the carrier and fastened using zippered fasteners 362. If an annular gap remains between the exterior of the bottle and the interior of the bottle carrier compartment, straps 352 can be tightened around the circumference of the housing to reduce the diameter somewhat so as to prevent excessive lateral movement of the bottle in the event of an impact. As mentioned above, the diameter of the housing can be made to vary along the length of the housing by selectively adjusting the tightness of the straps. The optional handle 382 shown at one end of the carrier can be used to carry the bottle carrier when it is not placed in luggage. While the handle is shown extending from the closed end of the carrier, it will be appreciated that a handle can be provided at either end or along the sides of the bottle carrier.

The bottle carrier according to the present invention can be formed with any number of compartments to allow one or more bottles to carried. For example, in FIGS. 21–24, a modification of a bottle carrier according to the present invention is shown wherein two compartments 421*a* and 421*b* are formed in the housing 420 of the modified carrier 410 to receive bottles. Housing 420 is similar to those described above but with a pair of flat sides or faces 484 and 486 connected by rounded edges 488 and 490. The housing is shown without any longitudinal zippers; however, it will be appreciated that a longitudinal separation or gap can be formed along any of the housing walls defining a compartment, and longitudinal edges of the gap can be fastened with longitudinal zippers if desired. A pair of straps 452 are shown extending circumferentially around housing 420 at longitudinally spaced locations along the length of the housing and carrying fasteners 446 in the form of hook and loop fasteners to provide adjustability; however, as with the other embodiments, any number of straps can be used. The compartments are similar to those described above and are formed in the housing in parallel relation to one another, with open ends facing in the same direction and neck protectors 424 disposed within each of the compartments. A single lid 422 is provided to close the compartments. The lid is similar to that described above in connection with FIGS. 16–20 but with a modified disk 436 of varying thickness contoured to fit snugly against the recess formed in the bottom of many bottles.

Figure 21:
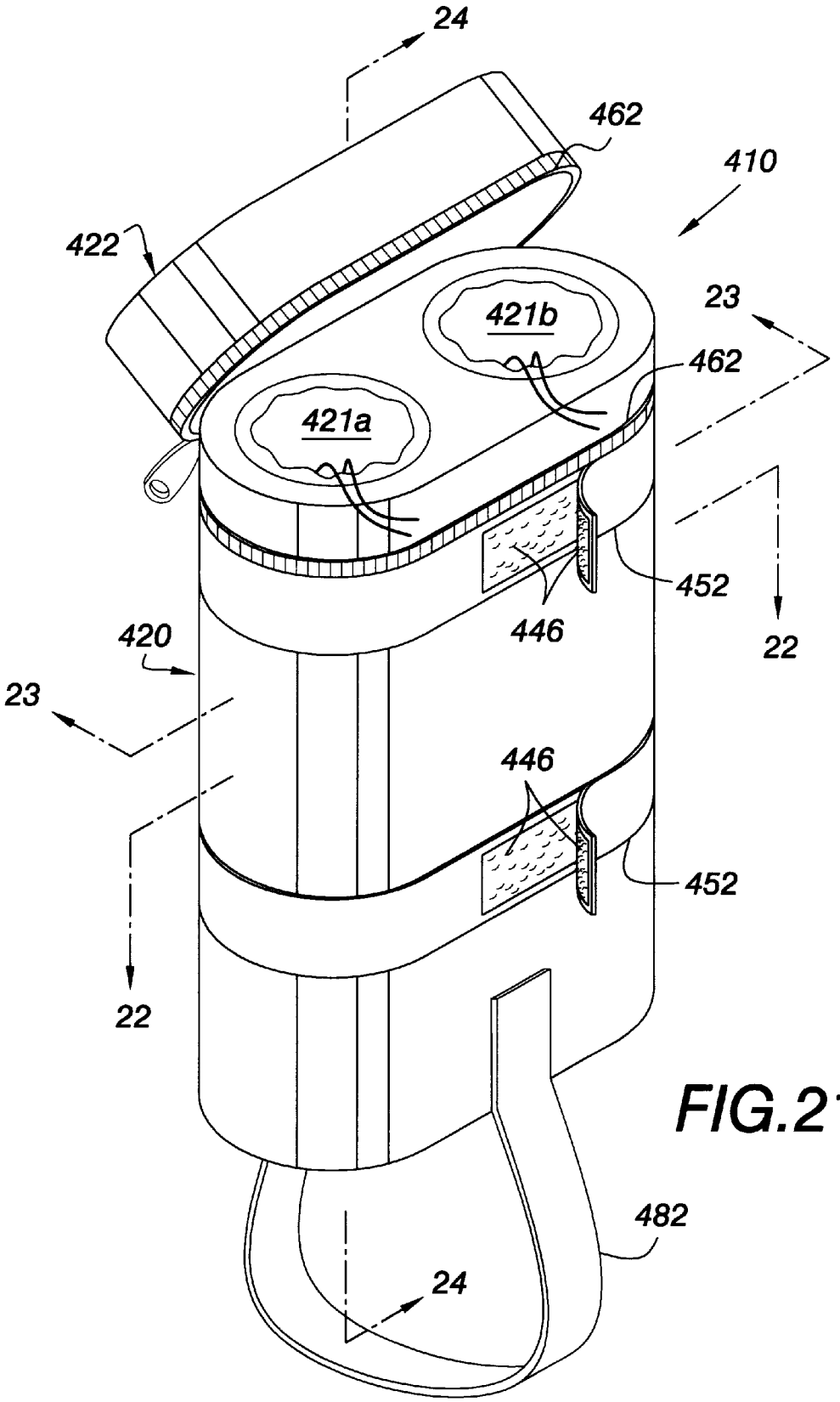
FIG. 21 is a top perspective view of still another modification of the bottle carrier according to the present invention.
Figure 24:
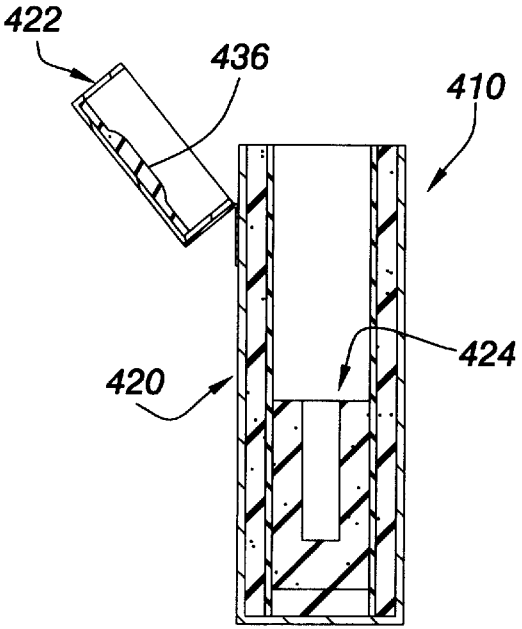
FIG. 24 is a sectional side view of the modified bottle carrier taken through line 24—24 in FIG. 21.
Figure 22:
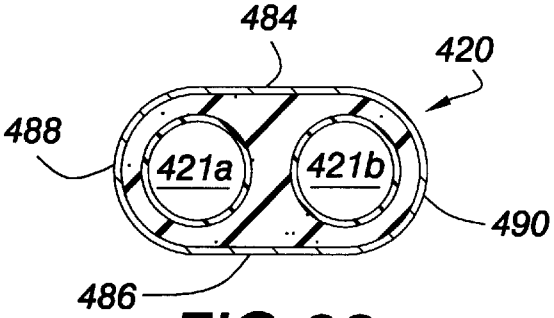
FIG. 22 is a sectional top view of the modified bottle carrier taken through line 22—22 in FIG. 21.
Figure 23:
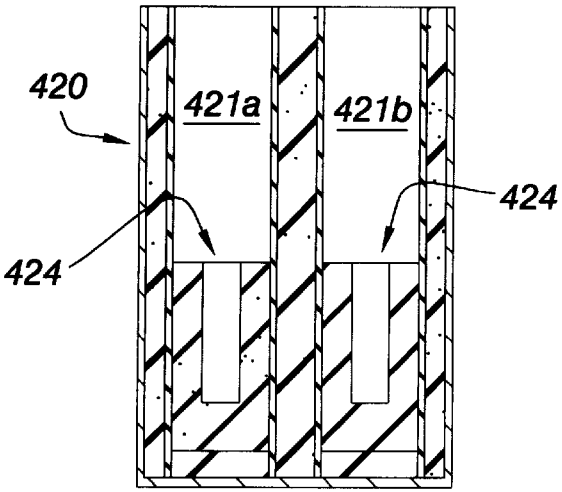
FIG. 23 is a sectional front view of the modified bottle carrier taken through line 23—23 in FIG. 21.
Figure 25:
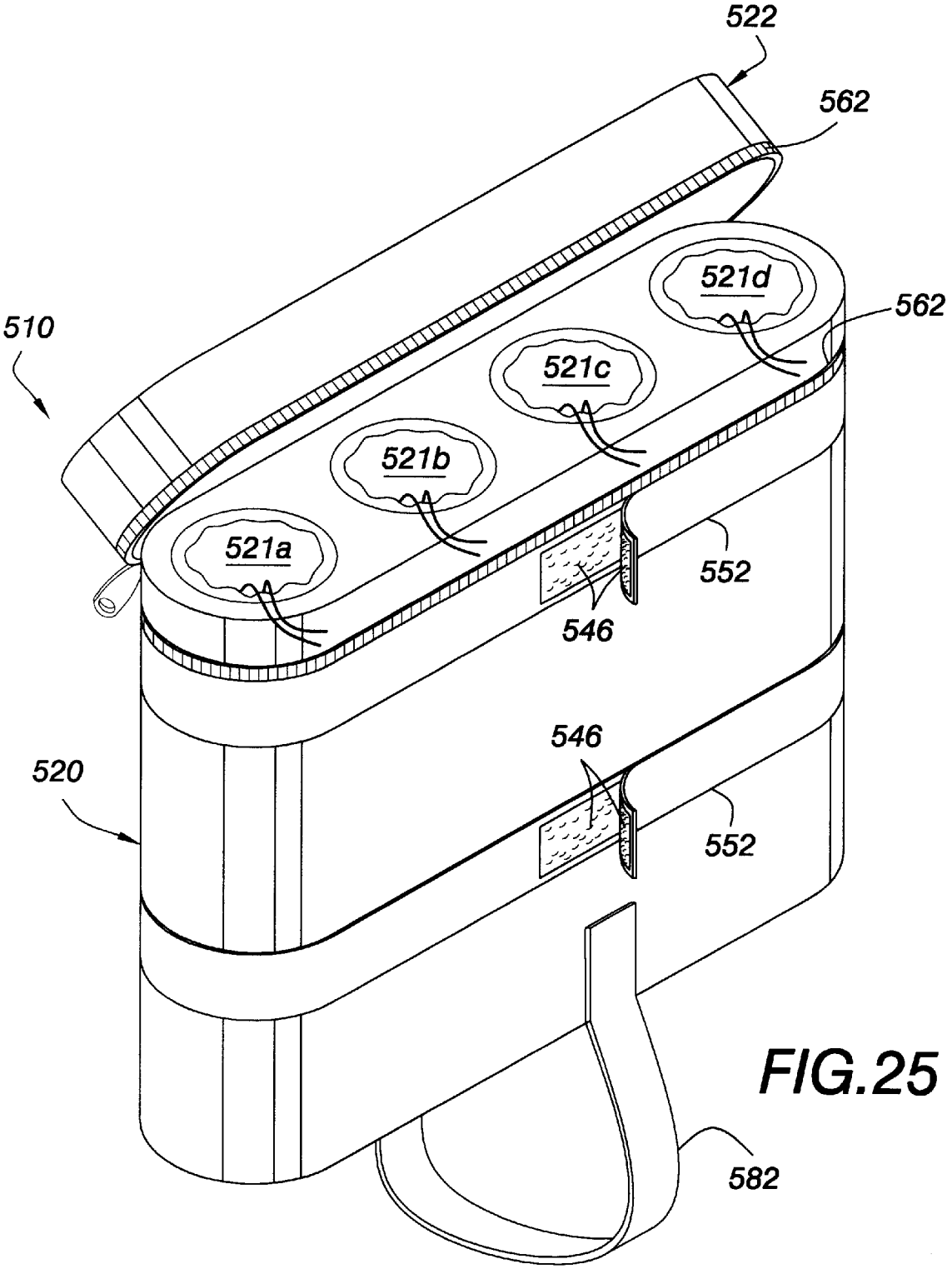
FIG. 25 is a top perspective view of a further modification of the bottle carrier according to the present invention.

Another modification of a bottle carrier according to the present invention, as illustrated in FIG. 25 at 510, is similar to the bottle carrier shown in FIG. 21 but with four compartments 521*a*, 521*b*, 521*c*, and 521*d* formed in housing 520 for carrying bottles. Lid 522 for the modified carrier is of sufficient size and shape to cover all of the compartment openings when closed and is shown fastened by a zipper 562. Adjustment straps 552 with hook and loop fasteners 546 extend around the exterior of the housing to provide adjustability as described above.

Figure 26:
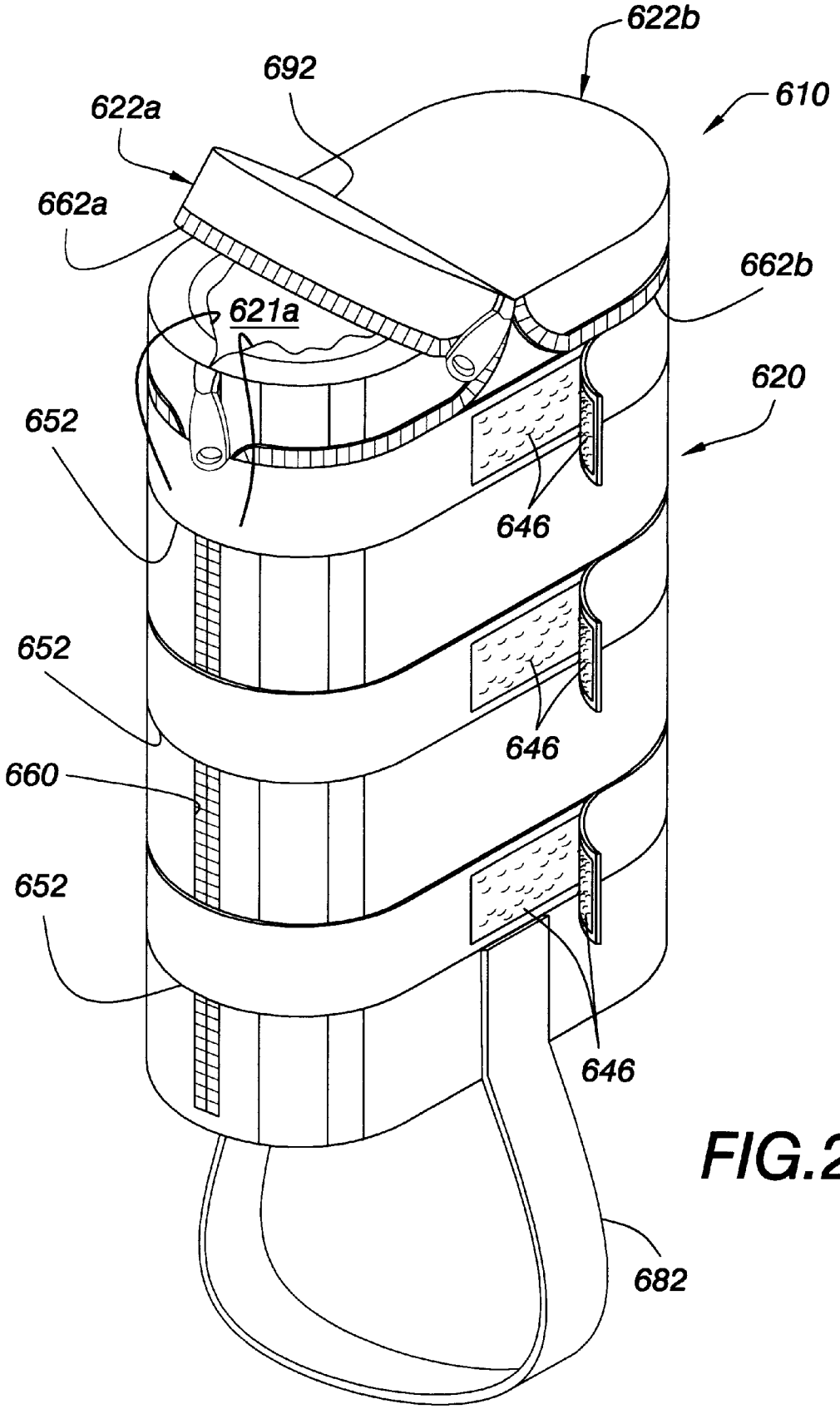
FIG. 26 is a top perspective view of an additional modification of the bottle carrier according to the present invention.

When a bottle carrier according to the present invention defines a plurality of compartments, open ends of the compartments can be covered by lids that extend across more than one compartment as shown above or by a plurality of lids that extend across individual compartments, for example as shown in FIG. 26. When multiple lids are employed, the lids can pivot about a common hinge or be separately hinged. In the modification shown in FIG. 26, the bottle carrier 610 is similar to those described above; however, a hinge 692 is defined between the compartments with separate lids 622*a* and 622*b* extending in opposite directions from the hinge to cover the compartments when in their respective closed positions. Lids 622*a* and 622*b* are similar to the lids described above. In FIG. 26, the lid 622*a* on the left is shown in a partially open condition, state or position and the lid 622*b* on the right is shown in a closed condition, state or position. The bottom edge of each lid is connected to an upper portion of the carrier housing by zippered fasteners 662*a* and 662*b*, respectively, extending part way around the periphery of the lid from the hinge to the fastener 660 which connects opposed longitudinal edges of the housing 620. As a result, if multiple bottles are being transported, it is possible to remove one of the bottles without the possibility of exposing the other bottle to harm.

From the above, it will be appreciated that the bottle carrier according to the present invention permits various types of necked bottles to be safely and conveniently transported in suitcases, duffel bags, backpacks, briefcases and other types of carry-on and checked luggage. Thus, while the bottle carrier has been illustrated as carrying a conventional wine bottle, it will be appreciated that other types of bottles can be carried including, but not limited to, empty bottles and bottles containing food stuffs or liquids such as beer, wine and liquor, cooking oils and perfume.

The components of the bottle carrier of the present invention can be made of any suitable materials and can be made of multiple parts of various configurations to simplify assembly and reduce manufacturing costs. For example, in the case of the bottle carriers shown in FIGS. 1 and 11, the cylindrical portion of the housing can be integrally formed with the end cap as a one-piece unit or the end cap can be formed separately and affixed to the cylindrical housing portion using adhesives or any other suitable techniques. While the end cap is shown inserted into one end of the cylindrical housing portion, it will be appreciated that the end cap can be made somewhat larger and attached to the end face of the cylindrical housing portion if desired. Also, a hinged connection between any of the lids described herein and the housing can be made by forming the flap with the outer housing covering as an integral one-piece unit or by forming the flap separately from the housing and using a fabric strip or other type of hinge. The straps and bands described above can be formed of any suitable material including, but not limited to, woven fabrics incorporating elastomeric materials allowing the straps and bands to stretch. Any number of straps or bands can be made to extend around the housing to vary a dimension of the carrier along the length of the housing. Some examples of the types of fasteners that can be used to connect ends of the straps and bands together include, but are not limited to, buckles, hook and loop fasteners, and buttons. When the housing is split longitudinally, opposed edges of the split can be joined by a zipper, buttons, hook and loop fastener or any other type of suitable fastener.

Moreover, at least one of the liner and outer covering of the bottle carrier of the present invention can be made of a liquid impermeable or resistant material to contain liquid within the carrier in the event the bottle breaks. In addition, use of an open-cell foam for the neck protector will allow spilled liquids to be absorbed.

The neck protector is preferably affixed to the housing in a permanent or removable manner, for example using adhesives, stitching or hook and loop fasteners such as VELCRO. While it is advantageous for the neck protector to be affixed within the housing, it will be appreciated that the neck protector can be placed within the housing without being affixed in any way. Similarly, the lids and end caps of the carrier can be made completely detachable from the housing if desired.

The carrier according to the present invention may be used alone in a single article of luggage to transport a single bottle or multiple carriers may be placed within a single article of luggage to transport a plurality of bottles. When multiple carriers are placed within a single article of luggage, the carriers can be affixed to one another, for example using hook and loop fasteners disposed along respective sides of the tubular carrier housings. When multiple carriers are arranged in layers within a single article of luggage, a sheet of semi-rigid closed-cell foam (e.g., about 0.5 inch thick) is preferably placed between the layers to further isolate the carriers from impact loads.

The features of the various embodiments described above can be combined in any manner desired dependent upon the operational requirements of the bottle carrier.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A portable carrier for transporting necked bottles comprising a tubular housing formed of a semi-rigid shock absorbing material and defining a compartment with an open end configured to receive a bottle;

a lid configured to fit over said open end of said compartment;

a neck protector formed of a flexible shock absorbing material disposed within said compartment and defining a recess for receiving the neck of the bottle; and at least one strap of adjustable length extending at least partly around said tubular housing to permit selective adjustment of a dimension of said housing.

2. A portable carrier for transporting necked bottles as recited in claim 1 and further comprising a plurality of straps extending at least partly around said tubular housing at a plurality of longitudinally spaced locations along a length of said housing.

3. A portable carrier for transporting necked bottles as recited in claim 1 wherein said strap includes opposite end portions, and further comprising cooperative fastening elements disposed on said opposite end portions of said strap to permit said strap to be fastened around said housing.

4. A portable carrier for transporting necked bottles as recited in claim 2 wherein each of said straps includes opposite end portions, and further comprising cooperative fastening elements disposed on said opposite end portions of each strap to permit said straps to be fastened around said housing.

5. A portable carrier for transporting necked bottles as recited in claim 1 and further comprising a drawstring extending circumferentially around said open end of said tubular housing.

6. A portable carrier for transporting necked bottles as recited in claim 1 and further comprising a fastener connecting said neck protector to said tubular housing in a detachable manner.

7. A portable carrier for transporting necked bottles as recited in claim 6 wherein one end of said tubular housing is closed and said fastener includes a hook and loop fastener disposed between said neck protector and said closed end of said tubular housing.

8. A portable carrier for transporting necked bottles as recited in claim 1 wherein said opening defined by said neck protector is sufficiently deep to cause said neck protector to cradle the shoulder of the necked bottle while defining an axial gap between the neck and a closed end of said housing.

9. A portable carrier for transporting necked bottles as recited in claim 1 and further comprising a liner with a smooth surface disposed along an interior surface of said tubular housing to reduce friction thereby easing insertion of the bottle into said tubular housing.

10. A portable carrier for transporting necked bottles as recited in claim 1 and further comprising an outer covering formed of a substantially water resistant material.

11. A portable carrier for transporting necked bottles as recited in claim 1 wherein said lid is hinged to said housing.

12. A portable carrier for transporting necked bottles as recited in claim 1 wherein said semi-rigid material is a high-density closed-cell foam and said flexible material is a low-density open-cell foam.

13. A portable carrier for transporting necked bottles as recited in claim 1 and further comprising a zipper fastening said lid to said housing.

14. A portable carrier for transporting necked bottles as recited in claim 13 wherein said lid includes a skirt receiving said open end of said housing and a component of said zipper is mounted on said housing at a location axially spaced from said open end of said tubular housing.

15. A portable carrier for transporting necked bottles as recited in claim 1 and further comprising a handle attached to said tubular housing.

16. A portable carrier for transporting necked bottles comprising a tubular housing formed of a semi-rigid shock absorbing material and defining a compartment with an open end configured to receive a bottle;

a lid configured to fit over said open end of said compartment;

a neck protector formed of a flexible shock absorbing material disposed within said tubular housing and defining an opening for receiving the neck of the bottle;

said tubular housing including at least a pair of opposed longitudinal edges, and further comprising an adjustable fastener for holding said opposed longitudinal edges together.

17. A portable carrier for transporting necked bottles as recited in claim 16 wherein said opposed longitudinal edges of said sheet overlap one another.

18. A portable carrier for transporting necked bottles as recited in claim 16 wherein said fastener includes a belt extending circumferentially across said longitudinal edges and having cooperative fastening elements disposed thereon to permit adjustment of the length of said belt.

19. A portable carrier for transporting necked bottles as recited in claim 16 wherein said fastener includes a zipper extending longitudinally between said longitudinal edges.

20. A portable carrier for transporting necked bottles as recited in claim 16 wherein said fastener includes a zipper extending longitudinally between said longitudinal edges and an adjustable strap extending around said housing in angled relation to said zipper.

21. A portable carrier for transporting necked bottles as recited in claim 16 wherein said opening defined by said neck protector is sufficiently deep to cause said neck protector to cradle the shoulder of the necked bottle while defining an axial gap between the neck and a closed end of said housing.

22. A portable carrier for transporting necked bottles comprising a housing formed of a semi-rigid shock absorbing material and defining a plurality of compartments with open ends configured to receive a bottle;

a lid configured to fit over at least one of said compartments;

a plurality of neck protectors formed of a flexible shock absorbing material, each of said neck protectors being disposed within one of said compartments and defining an opening for receiving the neck of a bottle; and at least one strap of adjustable length extending at least partly around said housing to permit selective adjustment of a dimension of said housing.

23. A portable carrier for transporting necked bottles as recited in claim 22 wherein at least one of said compartments is formed by a wall of said housing having a longitudinal gap therein defined by a pair of opposed longitudinal edges, and further comprising an adjustable fastener extending between said opposed longitudinal edges.

24. A portable carrier for transporting necked bottles as recited in claim 22 wherein said lid covers all of said compartments.

25. A portable carrier for transporting necked bottles as recited in claim 22 and further comprising a plurality of lids covering said respective compartments.

26. A portable carrier for transporting necked bottles as recited in claim 25 wherein two of said lids pivot about a common hinge defined between a pair of compartments.

27. A method of transporting necked bottles comprising the steps of inserting a bottle into an open end of a compartment defined by a housing formed of a high-density, closed-cell foam material;

placing the neck of the bottle in an opening defined at least part way through a neck protector formed of a low-density, open-cell foam material disposed within the compartment;

adjusting a dimension of the housing using a strap extending around the housing;

closing the open end of the compartment with a lid; and placing the bottle carrier in an article of luggage.

28. A method as recited in claim 27 wherein the housing includes opposed longitudinal edges joined by a zipper and further comprising, prior to inserting the bottle into the housing, the step of opening the zipper.

29. A method as recited in claim 28 and further comprising, after inserting the bottle into the housing, the step of closing the zipper.

30. A method as recited in claim 27 and further comprising, after inserting the bottle into the housing, the step of tightening a drawstring extending around the open end of the compartment.

* * * * *